US005634419A

United States Patent [19]

Cymara

[11] Patent Number: 5,634,419

[45] Date of Patent: Jun. 3, 1997

[54] FRONT-DRIVE BOAT

[76] Inventor: Hermann K. Cymara, 106 Stonehaven Cir., Newfield, N.Y. 14867

[21] Appl. No.: 669,758

[22] Filed: Jun. 26, 1996

[51] Int. Cl.[6] ..... B63B 1/00

[52] U.S. Cl. ..... 114/56; 440/5; 440/38

[58] Field of Search ..... 440/5, 38; 114/61, 114/56, 57, 140, 271, 274, 283, 288, 292, 123

[56] References Cited

U.S. PATENT DOCUMENTS

| | | | |
|---|---|---|---|
| 3,807,337 | 4/1974 | English et al. | 114/56 |
| 4,348,972 | 9/1982 | Parsons | 114/56 |
| 4,506,617 | 3/1985 | Waas et al. | 114/56 |
| 4,862,817 | 9/1989 | Hornsby, Jr. et al. | 114/56 |

*Primary Examiner*—Stephen Avila
*Attorney, Agent, or Firm*—Barnard, Brown & Michaels

[57] ABSTRACT

A watercraft having its propulsion machinery near the bow. The hull of the craft has a single, tapered bow section, with a drive pod under the center of the bow. The bow section is tapered up into the hull aft of the middle of the craft, while the sides of the craft are extended downward aft of the middle of the craft, forming a double hull at the rear. The drive pod is capable of freely rotating, allowing the craft to be steered by vectoring the thrust at the bow. Because the thrust is pulling the craft from the bow, rather than pushing from the stern, the craft is inherently stable in the manner of a front-wheel drive automobile.

8 Claims, 2 Drawing Sheets

FRONT-DRIVE BOAT

FIELD OF THE INVENTION

The invention pertains to the field of water craft. More particularly, the invention pertains to boats or ships having their drive mechanisms in the forward end of the craft.

BACKGROUND OF THE INVENTION

In the past, as is well known, the propulsive mechanism of nearly all watercraft was located at the stern (rear) of the craft (the sole exceptions being side-wheelers, long obsolete, or air/jet propelled craft such as hovercraft where the jet or propeller is above the craft). In outboard systems, the outboard motor is nearly always hung from the transom of the boat (some specialized work boats have an indentation into the transom, so that the outboard is slightly forward of the transom in a well). Even if the motor is located inboard toward the center or front (bow) of the boat, the propeller or jet exhaust is at the stern, either protruding from the transom (inboard/outboard or "Z" drive) or underneath.

In most inboard-motor cases, the steering of the watercraft is done by means of a steerable vane (the rudder) extending beneath the craft into the water. Jet-boats steer the jet exhaust at the rear of the craft, and outboards and inboard/outboards steer the drive unit or the entire motor/drive unit, usually through a limited range of 45° or so either side of center (although some earlier outboards and some very small trolling motors can be swiveled 360°, eliminating the need for a reversing gear).

In some very large ocean-going craft or tugboats, separate fixed propellers (called side-thrusters) may be mounted internally near the bow, set to propel water out either side of the ship. These side-thrusters are used for maneuvering the ship sideways into dock or (in the case of tugs) for maneuvering the tug relative to a ship. They are not steerable, and cannot provide propulsion under normal circumstances. That function is still performed by one or more propellers under the stern.

Placing the drive mechanism of a watercraft in the back has the same disadvantages which have recently led to the near-total replacement of rear-wheel drive automobiles with front-wheel drive—only worse, since watercraft have the steering in the rear as well. The result is inherent instability. Upon application of power, the boat tends to rear up and turn. Propelling and steering the boat from the rear is analogous to balancing a broom on the hand, instead of gripping it at the top of the handle.

SUMMARY OF THE INVENTION

The invention presents a watercraft having its propulsion machinery near the bow. The hull of the craft has a single, tapered bow section, with a drive pod under the center of the bow. The bow section is tapered up into the hull aft of the middle of the craft, while the sides of the craft are extended downward aft of the middle of the craft, forming a double hull at the rear. The drive pod is capable of freely rotating, allowing the craft to be steered by vectoring the thrust at the bow. Because the thrust is pulling the craft from the bow, rather than pushing from the stern, the craft is inherently stable in the manner of a front-wheel drive automobile.

DESCRIPTION OF THE PREFERRED EMBODIMENT

Figure 1:
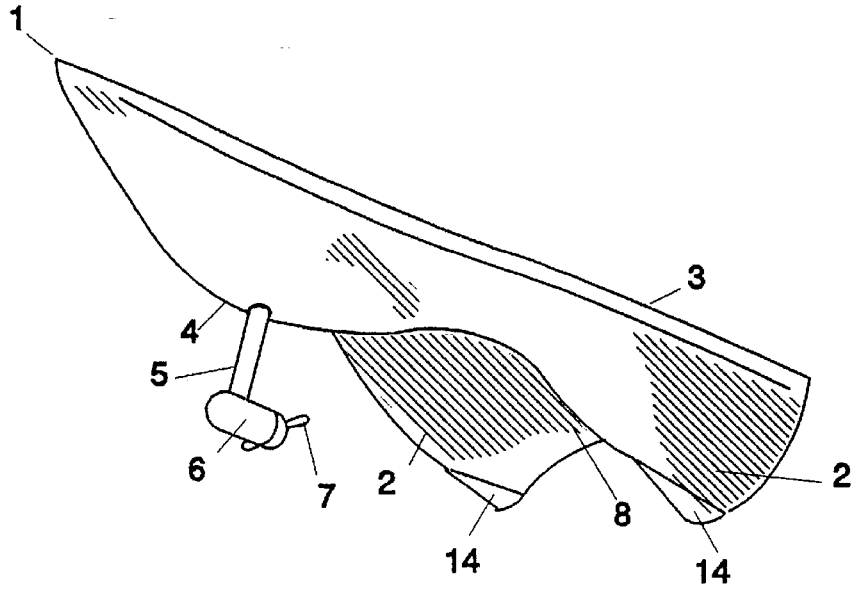
FIG. 1 shows a perspective view of the hull of a watercraft built according to the teachings of the invention.
Figure 2:
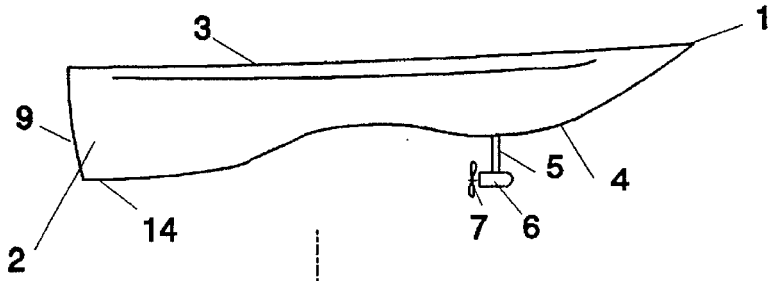
FIG. 2 shows a side view of the craft of FIG. 1.
Figure 3:
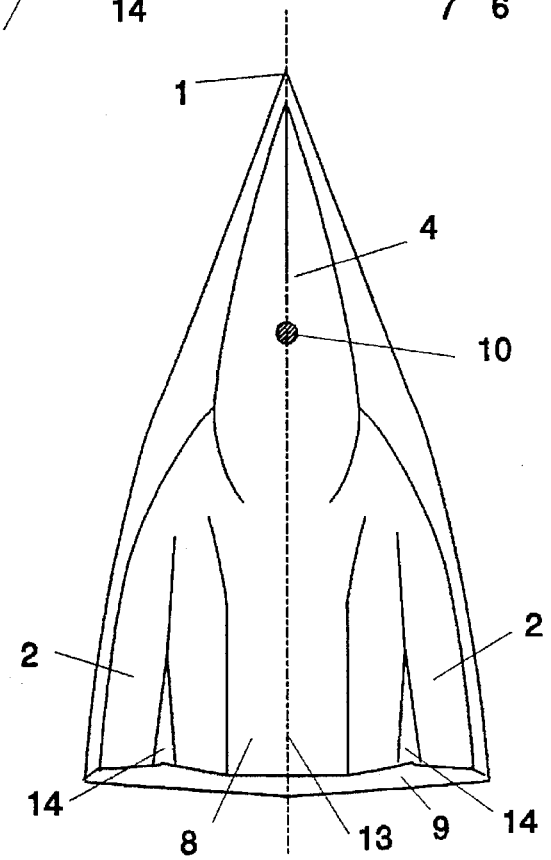
FIG. 3 shows a bottom view of the craft of FIG. 1, without the drive pod.

The invention presents a novel hull design for watercraft, which is especially useful with a front-drive propulsion system as taught by the invention. FIGS. 1 through 3 show the novel hull of the invention. No details of the upper structure of the hull are shown, as the superstructure of the watercraft, if any, is not relevant to the invention. The craft could be a small open runabout, with nothing more than a windshield in front of an open cockpit, or a large ocean-going vessel with an elaborate superstructure, or anything in-between.

Figure 4:
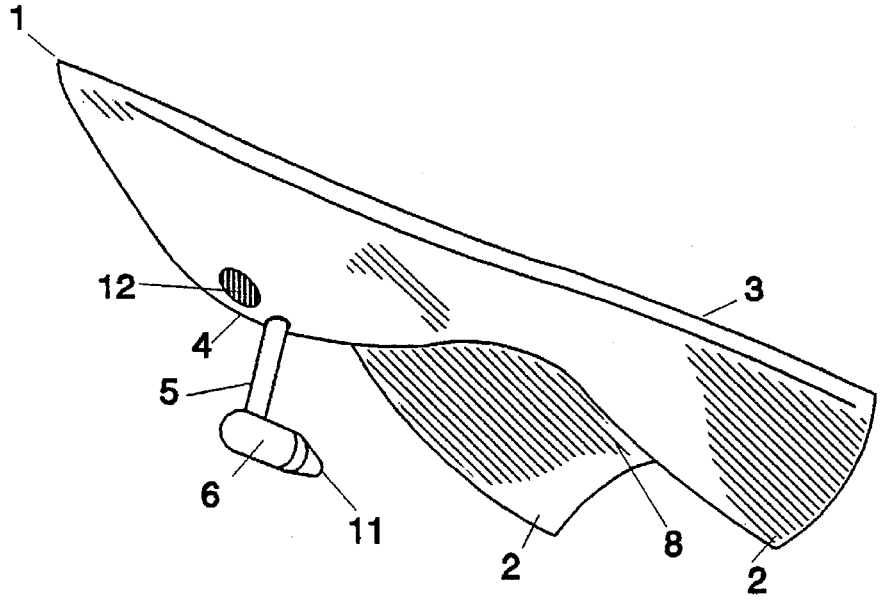
FIG. 4 shows perspective use of the hull of the invention, in which the propulsion mechanism is a jet-drive.

The hull has a generally triangular plan, as can be seen from the bottom view FIG. 4. The hull tapers to the bow (1), the vertical design of which could be smoothly tapered to a point as shown in the figures, or more vertical, if desired. The bow portion (1) of the hull extends downward on the hull centerline (13) along a forward keel section (4), with a generally "v" shaped cross-section becoming deeper, to a point where a pass-through (10) is provided for the propulsion mechanism.

Aft of the deepest point on the keel (4), the bow section becomes less deep and flatter, until it merges with the hull of the craft around the fore-and-aft center point (3). Aft of the center point (3), the hull becomes deeper in two aft keel sections (2) which emerge from the center portion of the hull (3) symmetrically about the centerline (13) of the hull, and become deeper and more pointed toward the stern (9), forming a less deep area (8) between. The craft preferably has a flat transom in the stern, possibly raked to some extent, as is shown in FIG. 2.

Preferably, the bottoms (14) of the aft-most portions of the aft keel sections (2) are flat, as shown in FIGS. 1–3, although they can also be V-shaped as shown in FIG. 4.

The hull can be formed by any method known to the art, such as molded plywood or, preferably, molded Fiberglas or other composite material.

In the preferred embodiment, the propulsion mechanism extends on a post (5) through the forward keel pass-through (10) to a propulsion pod (6). This is shown in FIGS. 1 and 2 as having a propeller (7), of any convenient design. The propulsion pod (6) can be pivoted by the post (5), preferably through a full 360°, so that the thrust of the propulsion mechanism can be vectored in any direction.

The actual prime mover for the propulsion system could be an electrical motor located in the propulsion pod (6), as is often done for trolling motors. Alternatively, the motor could be inside the hull, preferably a two- or four-cycle gasoline motor, with the power transmitted from an outboard motor type head down the post (5) via a shaft, with appropriate gearing within the pod (6) to drive the propeller (7). Alternatively, the gasoline motor in the hull could drive a pump to provide hydraulic fluid under pressure through tubing within the post (5) to an appropriate hydraulic motor within the pod (6).

It would also be possible within the teachings of the invention to omit the propeller in favor of a jet drive, as shown in FIG. 4. In such a case, water inlets (12) may be provided in the hull, through which water is pumped by a jet drive system, and then is transmitted down the post (5) to the propulsion pod (6) and is expelled through a nozzle (11). The jet drive pump and motor would be conventional, as is used in jet boats using stern-drive propulsion. With the hull and drive of the invention, however, the craft becomes far more maneuverable than present jet boats, in which the jet can only be diverted within a very limited range by gates or swivel nozzles in the stern.

The forward keel section (4) provides a stable steering area, as do the two aft keel sections (2). During forward travel, the propulsion pod (6) drives water into the area between the two aft keels (2), which provides additional stability and lift to the stern. The flat areas (14) on the bottoms of the aft keel sections (2) provide planing areas at high speed.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A watercraft hull having a bow and a stern with a body therebetween being of a generally triangular plan, wider at the stern than the bow, the hull comprising:

a) a bow section having a generally v-shaped keel, the bow section having a fore end at the bow of the hull and an aft end located substantially centrally along the hull, deepest at a point along the keel between the bow and stern, being tapered toward the fore end, and flattened toward the aft end;

b) two aft keels, symmetrically disposed on either side of the centerline of the hull, each having a fore end beginning at a point along the hull centrally between the bow and stern, and an aft end at the stern, the keels being deepest at the aft end, and tapering toward the fore end;

c) a propulsion pod mounted upon and extending below the bow section of the hull, having thrust means for exerting a thrust against the water, being centrally located on the bow section, the propulsion pod being capable of swiveling to vector the thrust.

2. The watercraft hull of claim 1, in which the thrust means of the propulsion pod is a propeller.

3. The watercraft hull of claim 2, further comprising:

a) a hollow cylindrical post passing through the hull in keel of the bow section thereof, having a lower end extending below the keel of the bow section and an upper end inside the hull, b) the propulsion pod being mounted on the lower end of the post, and comprising a power input, a power output connected to the propeller, and gear means for conveying power from the power input to the power output, c) an engine mounted on the upper end of the post, within the hull and above the propulsion pod, having a power output, and d) shaft means for conveying power passing through the post and connected to the power output of the engine and the power input of the propulsion pod.

4. The watercraft hull of claim 2, further comprising:

a) a hollow cylindrical post passing through the hull in keel of the bow section thereof, having a lower end extending below the keel of the bow section and an upper end inside the hull, b) the propulsion pod being mounted on the lower end of the post, and comprising a fluid motor having a hydraulic pressure input, a rotational power output connected to the propeller, and hydraulic motor means for converting hydraulic pressure from the hydraulic pressure input to rotational power applied to the propeller, c) an engine mounted within the hull, having a power output, d) hydraulic pump means having a mechanical power input connected to the power output of the engine, and a pressure output for pressurized hydraulic fluid, such that mechanical power applied at the mechanical power input is converted to hydraulic pressure at the pressure output, and d) tubing means for conveying pressurized hydraulic fluid passing through the post, having a first end connected to the pressure output of the hydraulic pump and a second end connected to the hydraulic pressure input of hydraulic motor in the propulsion pod.

5. The watercraft hull of claim 1, in which the thrust means of the propulsion pod is a water jet.

6. The watercraft hull of claim 5, further comprising:

a) a hollow cylindrical post passing through the hull in keel of the bow section thereof, having a lower end extending below the keel of the bow section and an upper end inside the hull, b) a water intake passing from the interior of the hull to the exterior of the hull below the waterline, c) an engine mounted within the hull, having a power output, d) water pump means having a mechanical power input connected to the power output of the engine, a water input connected to the water intake passing through the hull, and a pressure output for pressurized water, such that mechanical power applied at the mechanical power input causes water to be taken in at the water intake and supplied under pressure at the pressure output, e) the propulsion pod being mounted on the lower end of the post, and comprising a water pressure input and a water output nozzle connected thereto, f) tubing means for conveying pressurized water, passing through the post, having a first end connected to the pressure output of the water pump and a second end connected to the water pressure of the propulsion pod.

7. The watercraft hull of claim 1, in which the aft keels are generally v-shaped along their length from their fore end to the stern of the hull.

8. The watercraft hull of claim 1, in which the aft keels are generally v-shaped at their fore end and flattened at the stern of the hull.

* * * * *